US006470617B1

(12) United States Patent
Gregory et al.

(10) Patent No.: US 6,470,617 B1
(45) Date of Patent: Oct. 29, 2002

(54) FOLDING STOCK

(76) Inventors: Thomas M. Gregory, 307 Al Dr., Belgrade, MT (US) 59714; Robert A. Kincaid, 122 Bennett Dr., Bozeman, MT (US) 59718

( * ) Notice: Subject to any disclaimer, the term of this patent is extended or adjusted under 35 U.S.C. 154(b) by 0 days.

(21) Appl. No.: 10/003,172

(22) Filed: Oct. 31, 2001

(51) Int. Cl.[7] ..... F41C 23/04
(52) U.S. Cl. ..... 42/75.04; 42/75.02
(58) Field of Search ..... 42/75.04, 75.02, 42/8, 44

(56) References Cited

U.S. PATENT DOCUMENTS

| | | | | | |
|---|---|---|---|---|---|
| 652,583 | A | | 6/1900 | Baird | |
| 663,923 | A | | 12/1900 | Nicholson | |
| 1,070,441 | A | * | 8/1913 | Flues | |
| 1,816,313 | A | | 7/1931 | Burton | |
| 3,077,045 | A | * | 2/1963 | Smith | 42/41 |
| 4,299,046 | A | | 11/1981 | Atchisson | 42/40 |
| 4,328,635 | A | | 5/1982 | Klavestad | 42/12 |
| 4,574,510 | A | | 3/1986 | Nishikawa | 42/40 |
| 4,964,232 | A | | 10/1990 | Mainland et al. | 42/44 |
| 5,351,428 | A | | 10/1994 | Graham | 42/72 |
| 5,617,665 | A | | 4/1997 | Hoenig | 42/8 |
| 5,809,682 | A | * | 9/1998 | Richert | 42/75.04 |
| 5,933,998 | A | | 8/1999 | Plebani | 42/75.04 |

FOREIGN PATENT DOCUMENTS

| | | | | |
|---|---|---|---|---|
| BE | 199 379 | * | 3/1951 | 42/44 |
| DE | 811 564 | * | 8/1951 | 42/44 |
| FR | WO 95/12799 | | 5/1995 | |

* cited by examiner

*Primary Examiner*—Stephen M. Johnson

(57) ABSTRACT

A folding firearm comprises a stock supporting a receiver, the receiver defining a bore for receiving a first end of the firearm barrel. A forearm is operably pivotally connected to the stock. The forearm includes a barrel securing mechanism having a securement member. The firearm barrel has a surface adjacent to the first end for engaging the securement member. The securement member is matingly engageable with the surface of the barrel. The securement member, in response to pivotal movement by the forearm, moves into engagement with the surface to urge the first end of the barrel into the bore of the receiver when the firearm is pivoted into a firing position. The firearm also includes a locking mechanism capable of selectively locking the forearm in the firing position.

16 Claims, 4 Drawing Sheets

FOLDING STOCK

BACKGROUND OF THE INVENTION

The present invention relates to a folding stock for a firearm, particularly a rifle.

It is often desired to reduce the size of a firearm when it is not in use, such as when a firearm is to be carried into the field. In a conventional 10/22 rifle, the barrel is detachably connected to the receiver. The receiver has a bore for receiving an end of the barrel. The barrel has an external barrel notch which receives a tightening wedge. While the barrel may be removed by loosening the wedge, nevertheless the length of the stock is unchanged.

Baird, U.S. Pat. No. 652,583 discloses a folding gun in which the barrel is pivotally connected to the firing chamber. The firing chamber is also pivotally connected to the stock. The barrel and firing chamber may be folded so as to be received within a hollow portion of the stock.

Nicholson, U.S. Pat. No. 663,923 discloses a folding rifle. The rifle barrel is pivotally attached to a casing containing the firing mechanism. The barrel has a rearwardly projecting arm which, when the barrel is swung into the firing position, fits within a slot and is locked therein by a transversely-arranged spring-actuated pin, which crosses the slot and passes through an aperture in the arm.

Nishikawa, U.S. Pat. No. 4,574,510 discloses a barrel, locking mechanism for a break-open-action gun having a barrel and a mechanical section rotatably engaged with each other by a hinge-pin. The barrel and mechanical section have corresponding lug and receiver to provide intimate contact in order to receive the load when the gun is discharged.

Mainland et al., U.S. Pat. No. 4,964,232 disclose a trap gun stock in which the barrel pivots relative to the stock. The barrel has a downwardly extending barrel lug which cooperates with a latch mounted to the fore-end to resist movement of the barrel relative to the fore-end.

Plebani, U.S. Pat. No. 5,933,998 disclose a break-action shotgun which allows interchangeability of the barrels.

Nevertheless, there is still a need for a firearm in which the overall length of the stock may be reduced, in which the barrel may be easily removed and installed, and which secures the barrel snugly when the firearm is assembled.

BRIEF SUMMARY OF THE INVENTION

It is an object of the present invention to provide a folding stock which allows a firearm to be folded so as to reduce the length of the stock, and which allows the quick and easy removal of a firearm barrel, but nonetheless secures the barrel snugly when the firearm is ready for use.

In a first aspect of the invention, a folding firearm comprises a stock supporting a receiver, the receiver defining a bore for receiving a first end of the firearm barrel. A forearm is operably connected to the stock. The forearm includes a barrel securing mechanism having a securement member. The firearm barrel has a surface adjacent to the first end for engaging the securement member. The securement member is matingly engageable with the surface of the barrel. The securement member, in response to pivotal movement by the forearm, moves into engagement with the surface to urge the first end of the barrel into the bore of the receiver when the firearm is pivoted into a firing position. The firearm also includes a locking mechanism capable of selectively locking the forearm in the firing position.

In another aspect of the invention, a method is provided for attaching the barrel to a firearm. A stock is provided which supports a receiver. The receiver defines a bore for receiving a first end of a firearm barrel. A forearm is operably pivotally connected to the stock. The forearm includes a barrel securing mechanism and a securement member. A surface is provided on the firearm barrel adjacent to the first end for engaging the securement member. The securement member is positioned so as to be matingly engageable with the surface of the barrel. The securement member, in response to pivotal movement by the forearm, moves into engagement with the surface to urge the first end of the barrel into the bore when the forearm pivots into the firing position. A locking mechanism is provided that is capable of selectively locking the forearm in the firing position. The first end of the firearm barrel is inserted into the bore. The forearm is pivoted to engage the securement member with the surface. The locking mechanism is then locked to secure the forearm in the firing position.

The invention provides a number of advantages. The stock may be quickly and easily folded to reduce its length. When the stock is folded into a broken position, the firearm barrel may be easily and quickly removed by hand without the need to further mechanically release the barrel. When the stock is unfolded into a firing position, the forearm of the stock securely holds the barrel in place. There is no further need to secure the barrel other than to simply unfold the stock the into the firing position.

The foregoing and other objectives, features, and advantages of the invention will be more readily understood upon consideration of the following detailed description of the invention, taken in conjunction with the accompanying drawings.

DETAILED DESCRIPTION OF AN EMBODIMENT OF THE INVENTION

Figure 1:
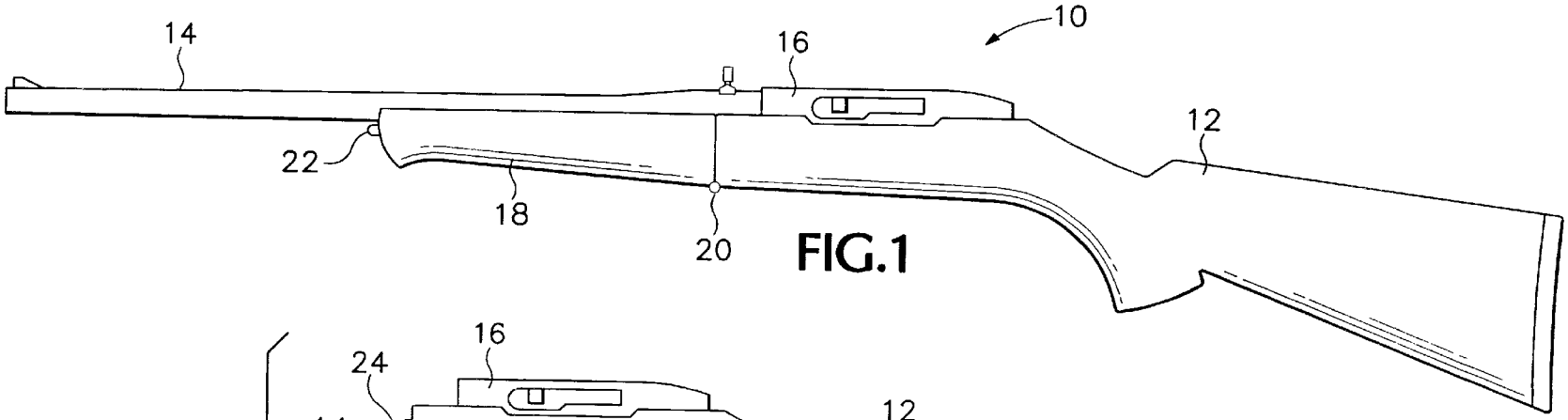
FIG. 1 shows a side view of an exemplary firearm of the present invention.
Figure 2:
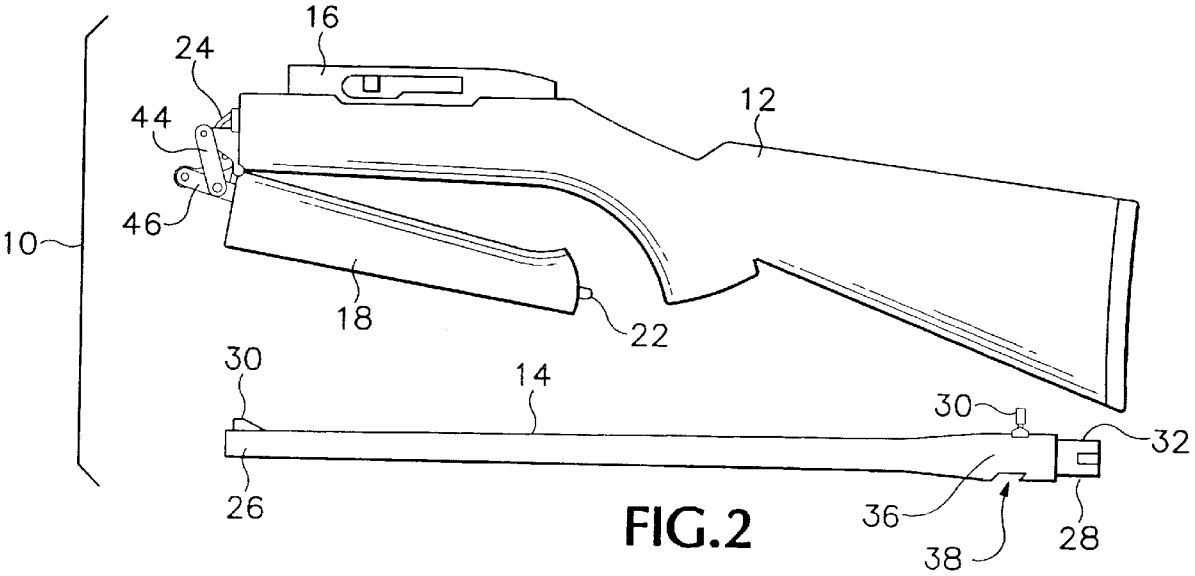
FIG. 2 shows a side view of the firearm of FIG. 1, showing the barrel removed and the stock folded.

Referring now to the figures, wherein like numerals refer to like elements, FIG. 1 shows a firearm 10 having a stock 12, a barrel 14, a receiver 16 and a forearm 18. The forearm 18 is pivotable with respect to the stock 12 by means of a hinge 20 connected to the receiver 16. When a release button 22 is pressed, the forearm 18 may be pivoted downwardly away from the barrel 14, as shown in FIG. 2. When the forearm 18 is pivoted away as shown in FIG. 2, the barrel 14 may be removed by hand from the receiver 16. This allows the firearm 10 to be disassembled for ease of storage and transportation. To assemble the firearm 10, the barrel 14 is inserted into the receiver 16. The forearm 18 is pivoted upwardly from the broken position to the firing position. A catch 24 secures the firearm barrel 14 to the receiver 16 as the forearm 18 pivots.

The stock 12 and forearm 18 may be formed of any suitable material, such as wood or plastic. In one embodiment, the stock 12 is formed from a moldable, polymeric material.

The barrel 14 of the firearm 10 shown in the figures is a conventional 10/22 firearm barrel. The firearm barrel 14 has a forward muzzle end 26, a rearward breech end 28, and a pair of sights 30. The breech end 28 has a reduced diameter section 32 which is adapted to be received by a bore 34 of the receiver 16. The breech end 28 also has a center section 36 having a conventional barrel notch 38 formed in a portion thereof. The interior of the notch 38 has one or more surfaces 40 which engage a securement member as described in more detail below. The securement member presses against the surface 40 to urge the breech end 28 of the barrel 14 into the bore 34, securing the firearm barrel 14 with respect to the receiver 16.

Figure 3:
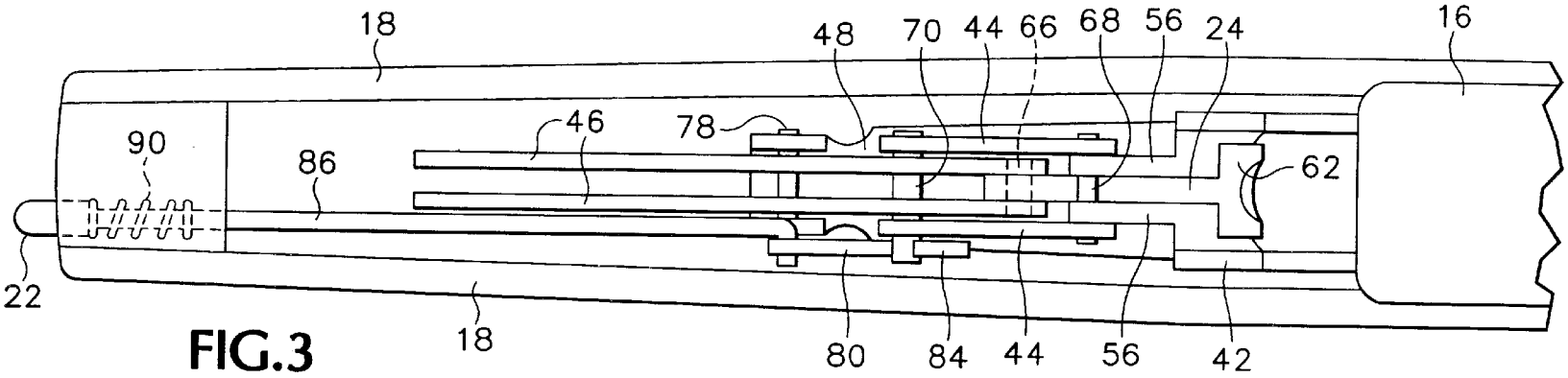
FIG. 3 shows a top view of the forearm of the stock of the firearm of FIG. 1 with the barrel removed and the stock in position for firing.

The forearm 18 of the stock 12 has a barrel securing mechanism which secures the barrel 14 to the receiver 16 when the forearm 18 is unfolded to a firing position. The barrel securing mechanism has a securement member which engages the surface 40. The securement member moves into and out of engagement with the surface 40 in response to pivotal movement of the forearm 18. Referring now to FIG. 3, which shows a top view of the forearm 18 and an exemplary barrel securing mechanism, the barrel securing mechanism comprises a mount 42, a securement member in the form of the catch 24, a pair of links 44, a pair of handles 46, and a hinge plate 48. The mount 42 is comprised of two side portions 56 which define between them an opening for receiving the catch 24. The lower end of each side portion of the mount has a bore 50. The hinge plate 48 also has a pair of bores 52. The respective bores of the mount 42 and hinge plate 48 are aligned to receive a rivet 54, so that the hinge plate 48 may pivot with respect to the mount 42. The hinge plate 48 is secured to the forearm 18, so that the forearm 18 may pivot with respect to the stock.

The barrel securing mechanism has the advantage that it is easily attached to the receiver 16. The receiver 16 has a pair of bores beneath the gun barrel receiving bore for receiving mounting bolts (not shown). This allows the mount 42 to be bolted directly to the receiver 16. Since the forearm 18 is pivotally connected to the mount 42 by a hinge mechanism, the entire forearm 18 and barrel securing mechanism is secured to the receiver by simply bolting the mount 42 to the receiver 16. Conversely, the forearm 18 and barrel securing mechanism may be easily detached from the receiver 16.

Figure 6:
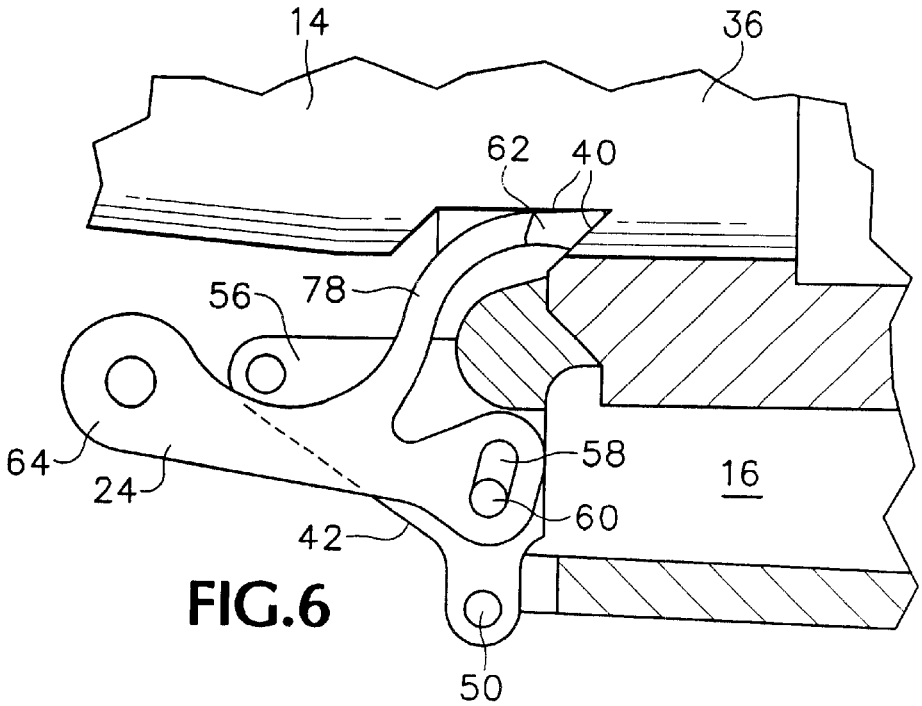
FIG. 6 shows a detail view of the catch matingly engaging the barrel, with the receiver block shown in sectional view.
Figure 7:
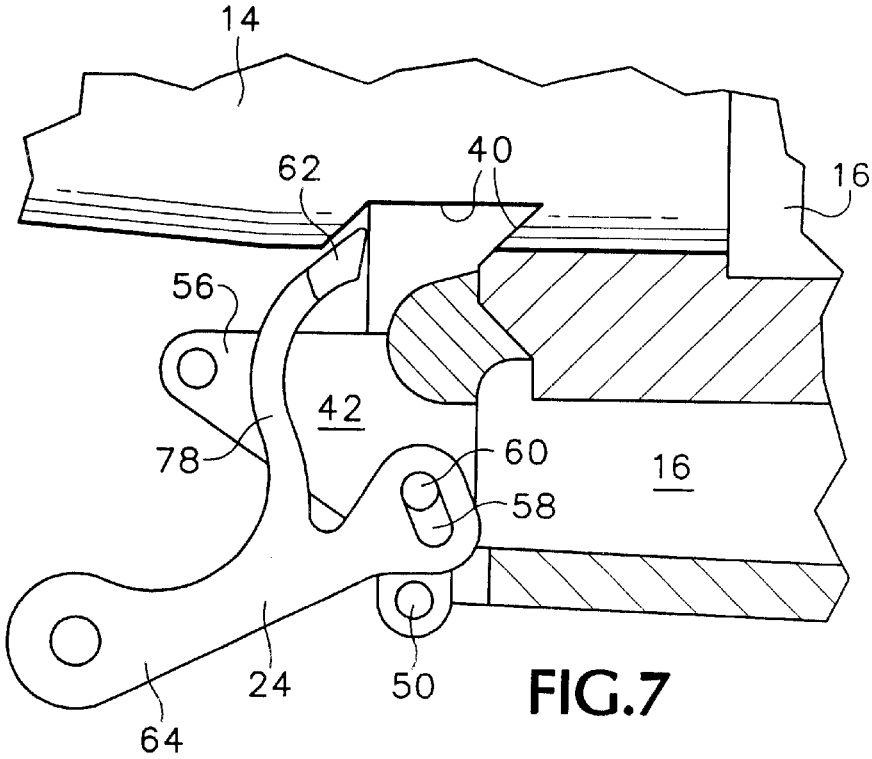
FIG. 7 shows a detail view of the catch being moved to a position out of engagement with the barrel, to allow the barrel to be removed from the firearm.

The catch 24 is used to mechanically secure the barrel 14 to the receiver 16. The catch 24 is shown in more detail in FIGS. 6 and 7. The catch 24 has an upper tapered end 62 which matingly engages the interior surface 40 of the barrel notch 38. A lower end of the catch 24 has a slot 58 for receiving a rivet 60 disposed between the two side portions 56 of the mount 42. The catch 24 is thus pivotable with respect to the mount 42. The catch 24 may be pivoted rearward, such that the tapered end 62 engages in the barrel notch 38. When this occurs, is shown in FIG. 6, the catch 24 urges the breech end 28 of the barrel 14 into the bore 34, thus snugly securing the barrel 14 with respect to the receiver 16. When the catch 24 is pivoted away, as shown in FIG. 7, the tapered end 62 of the catch 24 is removed from the barrel notch 38, allowing the barrel 14 to be removed. The catch 24 thus moves toward and away from the receiver 16 so as to selectively engage or disengage the interior or surface 40 of the notch 38 in response to pivotal movement of the forearm 18.

Figure 4:
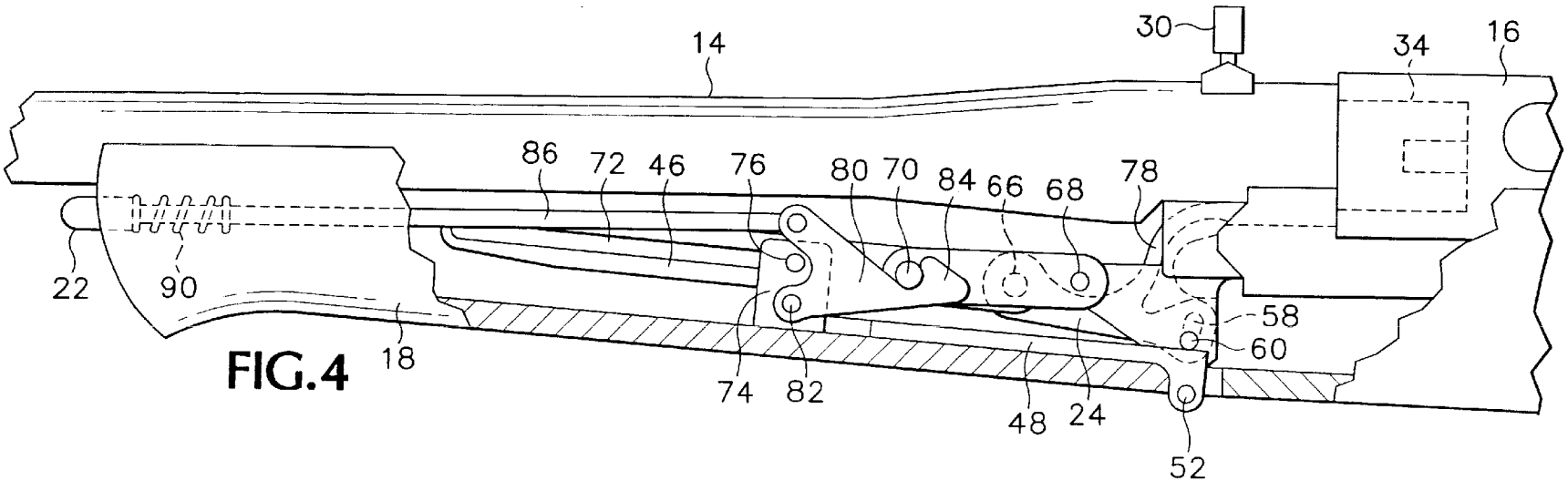
FIG. 4 shows a partially cutaway side view of the forearm of the firearm of FIG. 1 with the barrel attached.

As shown in FIGS. 3 and 4, the catch 24 is moved by means of the handle 46 and links 44, which interact with the forearm 18 when the forearm 18 is pivoted to cause the catch 24 to pivot with respect to the mount 42. The two handles 46 are mounted side by side so as to define an opening therebetween at the rear of the handles 46 for receiving the forward portion 64 of the catch 24. Each of the handles 46 has a bore, as does the forward portion of the catch. The respective bores of the handles 46 and catch 24 are aligned to receive a pin 66. The handle 46 is also connected to the mount 42 by means of two links 44. The rearward end of each of the links is connected by a single rivet 68 to the two side portions 56 of the mount 42, while the forward end of each of the links 44 is connected by a step rivet 70 to the handles 46. The forward end of each of the handles 46 has an elongated slot 72. The hinge plate 48 has a pair of ears 74 extending upwardly on either side of the two handles 46. Each of the slots 72 receives a rivet 76 which is disposed between the two ears 74 of the hinge plate 48.

Figure 5:
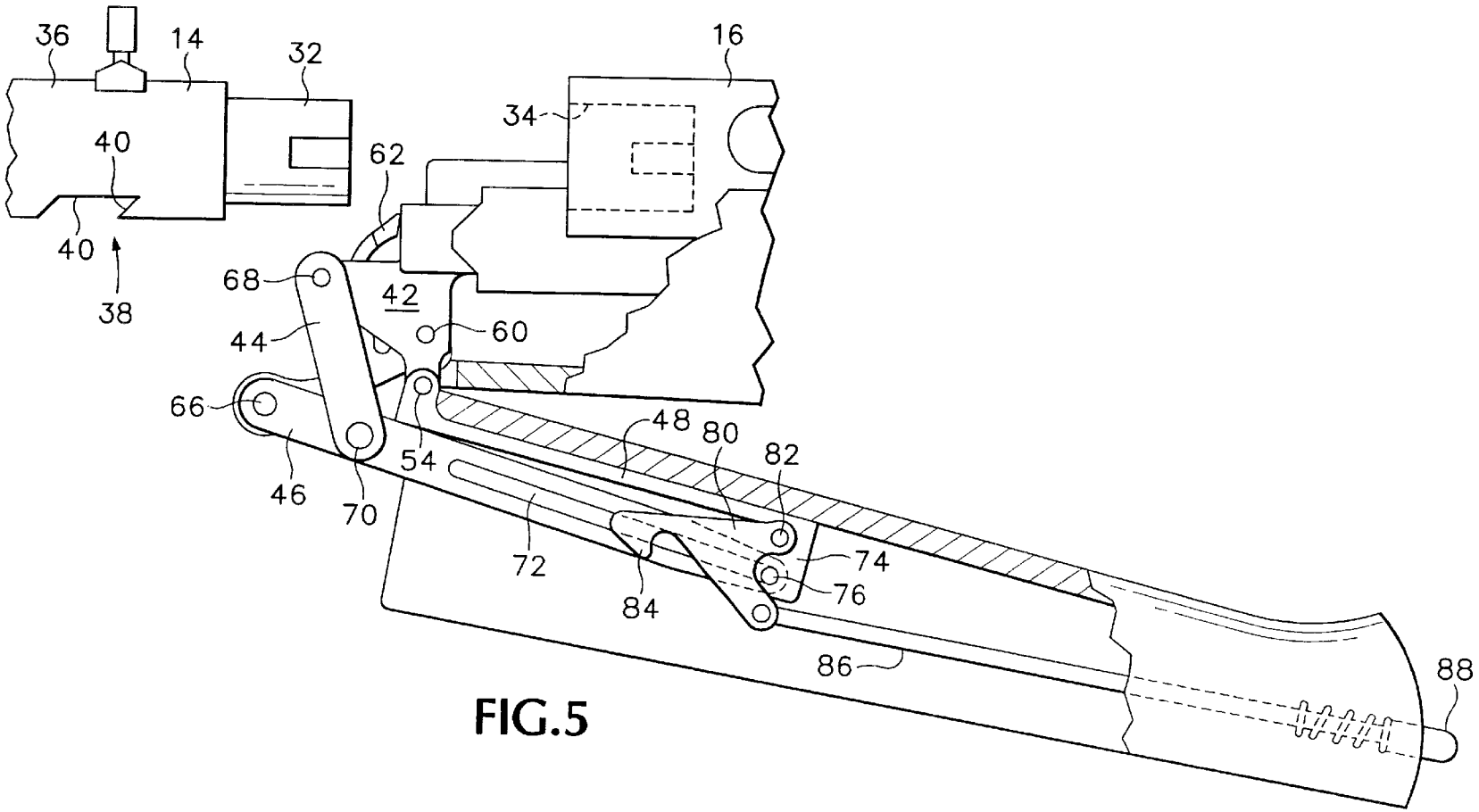
FIG. 5 shows a partially cutaway side view of the forearm of the firearm of FIG. 1 with the barrel removed and the stock folded.

The mechanical linkages between the hinge plate 48, handles 46, links 44, mount 42 and catch 24 cause the catch 24 to pivot rearward (as shown in FIG. 6) when the forearm 18 is pivoted to the firing position, and to pivot forward (as shown in FIG. 7) when the forearm 18 is pivoted to the broken position. Referring now particularly to FIG. 5, when the forearm 18 is pivoted to the broken position, the rivet 76 between the ears 74 of the hinge plate 48 is located at the extreme forward portion of the slot 72. The location of the other end of the handles 46 is determined by the links 44, which are connected to the mount 42. As the forearm 18 pivots, the rivet 76 causes the forward end of the handles 46 to pivot as well, while the links 44 maintain the spaced relation between the rearward end of the handles 46 and the mount 42. The net effect is to cause the extreme rearward end of the handles 46 to pivot upward and toward the receivers This causes the catch 24 to pivot rearwardly as well, thus forcing the tapered end 62 of the catch 24 into the notch 38.

In a preferred embodiment of the invention, the catch 24 includes a spring portion 78. As shown in more detail in FIGS. 6 and 7, the catch 24 has a goose-neck portion which acts as a spring. This provides several advantages to the securing mechanism. The upper tapered end 62 provides constant compression force against the barrel notch 38, thus continuously urging the barrel 14 into engagement with the receiver. In addition, the spring portion 78 allows the catch 24 to take up force from the handles 46 without damaging the breech end. This allows for a wider variability in the mechanical linkages and diminishes the need for exact mechanical tolerances. In addition, to allow for greater freedom of movement of the securing mechanism, the catch 24 is provided with a slot 58 to connect the catch 24 to the mount 42.

Alternatively, other barrel securing mechanisms may be provided having a securement member that engages the interior surface of the barrel notch. For example, a securement member may be provided that slides along a rail or track into and out of engagement with the interior surface 40 of the barrel notch 38. The forearm may have a member that abuts into the securement member when the forearm is pivoted into the firing position. The pivotal movement of the forearm may thus urge the securement member into engagement with the interior surface of the barrel notch by compression rather than through a mechanical linkage connecting the forearm with the securement member.

The forearm 18 also has a locking mechanism for securing the forearm 18 in the firing position, but which may be released to allow the forearm 18 to pivot to the broken position. Referring now more particularly to FIGS. 3 and 4, the forearm 18 has a lock 80 attached to the hinge plate 48 by means of a rivet 82. The lock 80 is thus capable of pivoting with respect to the hinge plate 48. The lock 80 has a hook 84. As shown in FIGS. 3 and 4, when the locking mechanism is in the locked position, so as to lock the forearm in the firing position, the hook 84 extends around the end of the step rivet 70. Since the step rivet 70 is connected to the links 44, which in turn are connected to the mount 42, the hinge plate 48, and thus forearm 18, is prevented from pivoting.

The locking mechanism also includes a release rod 86. The release rod 86 is located in the forward end of the forearm 18. The rear end of the release rod is connected to the upper portion of the lock 80. The forward end of the release rod 86 has a release button 22. A spring 90 urges the release rod 86 in a forward direction. When the release button 22 is depressed, the release rod 86 moves rearward. This causes the lock 80 to pivot downward and rearward, and unhooks the hook 84 from the step rivet 70. The forearm 18 is then free to pivot to the broken position, shown in FIGS. 2 and 5.

Alternatively, other locking mechanisms may be provided. For example, instead of providing a mechanical linkage to interconnect the locking mechanism to the receiver through a mount, the locking mechanism may directly interconnect the forearm with the stock. As yet another alternative, the locking mechanism may directly connect to the mount. All that is required is that the locking mechanism be capable of securing the forearm in a firing position, and that the locking mechanism be selectively disengageable so that the forearm may be pivoted to a broken position.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A folding firearm, comprising:

(a) a stock supporting a receiver defining a bore for receiving a first end of a firearm barrel, and a forearm operably pivotally connected to said stock;

(b) a locking mechanism capable of selectively locking said forearm in a firing position;

(c) a barrel securing mechanism located proximate to said receiver having a moveable securement member;

(d) said firearm barrel having a surface adjacent said first end for selectively engaging said securement member; and (e) said securement member being matingly engageable with said surface of said barrel, and said securement member in response to pivotal movement by said forearm moving into engagement with said surface to urge said first end of said barrel into said bore when said forearm is pivoted into said firing position.

2. The firearm of claim 1 wherein said barrel securing mechanism includes a mount attached to said receiver.

3. The firearm of claim 1 wherein said barrel securing mechanism includes a hinge.

4. The firearm of claim 1 wherein said securement member is a catch.

5. The firearm of claim 1 wherein said surface is a portion of a notch defined in said barrel.

6. The firearm of claim 1 wherein said barrel securing mechanism further includes a spring portion associated with said securement member.

7. The firearm of claim 2 wherein said locking mechanism selectively operably interconnects to said mount.

8. The firearm of claim 1 wherein said securement mechanism comprises an elongate member operably connecting said forearm to said securement member.

9. The firearm of claim 1 wherein said forearm and said barrel securing mechanism are detachable from said receiver.

10. A method for attaching a barrel to a firearm, comprising:

(a) providing a stock supporting a receiver, said receiver defining a bore for receiving a first end of a firearm barrel, and providing a forearm operably pivotally connected to said stock;

(b) providing a locking mechanism capable of selectively locking said forearm in a firing position;

(c) providing a barrel securing mechanism proximate to said receiver and having a moveable securement member;

(d) providing a surface on said firearm barrel adjacent to said first end for selectively engaging said securement member;

(e) positioning said securement member to be matingly engageable with said surface of said barrel, so that said securement member in response to pivotal movement by said forearm moves into engagement with said surface to urge said first end of said barrel into said bore when said forearm is pivoted into a firing position;

(f) inserting said first end of said firearm barrel into said bore;

(g) pivoting said forearm to engage said securement member with said surface to secure said first end of said barrel in said bore; and (h) locking said locking mechanism to lock said forearm in said firing position.

11. The method of claim 10 wherein said barrel securing mechanism includes a mount, and further comprising the step of attaching said mount to said receiver.

12. The method of claim 10 wherein said barrel securing mechanism includes a hinge.

13. The method of claim 10, further comprising the step of forming said securement member to have a tapered end.

14. The method of claim 10, further comprising providing a spring portion associated with said securement member.

15. The method of claim 11 wherein said locking mechanism selectively operably interconnects to said mount.

16. The method of claim 10, further comprising operably interconnecting said forearm to said securement member with an elongate member.

* * * * *